United States Patent [19]

Carmien

[11] 3,935,055

[45] Jan. 27, 1976

[54] ASSEMBLY TOOL FOR USE IN ATTACHING FIBERGLASS TOOL HANDLES

[75] Inventor: Joseph Allen Carmien, Beverly Hills, Calif.

[73] Assignee: Nupla Corporation, Sun Valley, Calif.

[22] Filed: Aug. 30, 1974

[21] Appl. No.: 502,088

[52] U.S. Cl. ..... 156/443; 29/242; 76/103; 145/29 R; 156/475; 156/581; 269/275

[51] Int. Cl.[2] ..... B31F 1/00

[58] Field of Search ..... 156/212, 228, 229, 293, 156/294, 423, 443, 475, 486, 488, 493, 496, 579, 581, 494; 76/103; 100/211; 269/275; 29/242, DIG. 1; 145/29 R; 403/268; 264/249, 292, 263

[56] References Cited

UNITED STATES PATENTS

| | | | |
|---|---|---|---|
| 2,519,661 | 8/1950 | Johnson | 269/275 |
| 2,708,305 | 5/1955 | Ohl | 29/242 |
| 3,681,160 | 8/1972 | Richie et al. | 156/212 |

*Primary Examiner*—Douglas J. Drummond
*Assistant Examiner*—J. J. Gallagher
*Attorney, Agent, or Firm*—Robert C. Comstock

[57] ABSTRACT

An assembly tool for use in attaching fiberglass handles to tools and the like. A tape applicator is mounted for reciprocal vertical movement by a double-acting hydraulic cylinder. A tool head is mounted beneath the applicator with masking tape overlying one end of the tool head opening. The applicator comprises a hollowed resilient pad which draws the masking tape tightly across the top of the opening and then presses it into sealing engagement with the entire periphery of the opening. The opening is thereby sealed against leakage of potting compound inserted into the opening to bond a handle to the tool head.

3 Claims, 5 Drawing Figures

ASSEMBLY TOOL FOR USE IN ATTACHING FIBERGLASS TOOL HANDLES

BACKGROUND OF THE INVENTION

1. Field of the Invention

The invention relates to an assembly tool for use in attaching fiberglass handles to tools and the like.

2. Description of the Prior Art

At the present time, fiberglass tool handles are customarily assembled with the tool in a vertical position. The tool head is disposed uppermost, with the handle therebeneath. The handle is inserted into the tool head opening from the bottom of the opening. Potting compound is then poured into the top of the tool head opening, depending upon the force of gravity to cause the potting compound to fill the areas within the tool eye opening which are not filled by the handle.

If an inverted position is used in the assembly operation, the top of the tool head opening becomes the bottom and it must be sealed off, customarily with masking tape. If the masking tape is applied by hand, it is time consuming for the operator applying the tape to try to smooth it manually so that a perfect seal is formed around the entire peripheral edge of the tool head opening and to eliminate sags, wrinkles and folds in the tape surface which would be faithfully reproduced in the surface of the potting compound. If there should not be such a perfect seal, the potting compound will leak out, destroying the assembly and possibly gumming up the assembly apparatus as well, which is often due to irregular edges and complex shapes of many tool eye openings.

Manual application of the masking tape is the only method now in use. It is time consuming and therefore costly and it is also likely to be faulty or imperfect.

SUMMARY OF THE INVENTION

The invention relates to an assembly tool for use in attaching fiberglass handles to hand tools and the like which is particularly designed and adapted to automatically apply a piece of masking tape over the tool head quickly, perfectly and "drum-head" tight each time it is used.

It is accordingly among the primary objects of the invention to provide such an assembly tool which is faster and more economical than the manual methods of assembly which are now in use.

It is particularly an object of the invention to provide such a device which is automatic in operation and which provides a complete seal around the entire peripheral edge of the tool head opening, to provide a smooth "drum-head" surface which insures a sightly potted surface when the tape is removed.

The present invention is particularly adapted for use in connection with the apparatus, techniques and inventions of patent applications Ser. Nos. 473,273, 473,274 and 473,275, all filed May 28, 1974.

In essence, the present invention contemplates a device for applying masking tape to a tool head which will first draw the tape drumhead tight across the top of the tool head opening, then pull the sides of the tape down and then apply downward and inward pressure to seal the tape in uniformly tight relationship to the tool head and to the entire periphery of the tool head opening. The masking tape must be sealed sufficiently to prevent any leakage of potting compound from the tool head opening.

It is accordingly among the objects of the invention to provide such a device and thereby to provide an assembly tool and technique which is capable of being operated by relatively unskilled employees, thereby reducing labor costs as well as providing better products and improved product assembly.

It is an object of the invention to provide an assembly tool having all of the advantages and benefits set forth above and described hereinafter in further detail in this specification.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
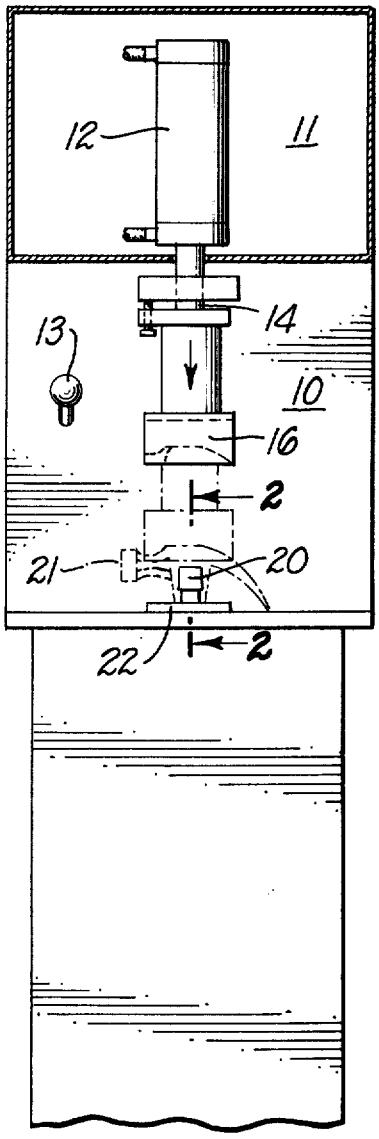
FIG. 1 is a front elevational view of an assembly tool constructed in accordance with the present invention, with the tool head and the lowered position of the tape applicator shown in phantom lines.

A preferred embodiment which has been selected to illustrate the invention comprises a vertically directed panel 10, above which is an enclosure 11 which contains a double-acting hydraulic cylinder 12. The cylinder 12 is conventional in its structure and operation and accordingly requires no detailed description. A control knob 13 is movable downwardly to control the operation of the cylinder 12 to cause downward movement of a shaft 14 which extends downwardly from the cylinder 12. The lower end of the shaft 14 is secured to the upper end of a connector 15. The lower end of the connector 15 is in turn attached to the upper end of an applicator housing 16. Mounted within the applicator housing 16 is a tape applicator 17, which preferably comprises a substantially resilient pad of cast silicone rubber having a Shore A hardness in the range between 20 and 60. A hardness of approximately 30 has been found to provide particularly satisfactory results in use. Other suitable materials may also be used, such as polyurethane, vinyl or natural rubber.

The lower midportion of the applicator 17 has a concave hollow portion 18 which is preferably formed substantially complementarily to the contour of the upper portion of the tool head 21 to which masking tape is to be applied.

Mounted directly beneath and in alignment with the applicator 17 is a tool head holder 20, which is adapted to removably receive and hold in place a tool head 21, comprising a hammer head in the drawings for purposes of illustration. The tool head holder 20 is mounted on a base 22 which extends transversely outwardly from the panel 11. In use, the lower surface of the tool head 21 rests upon the base 22. The holder 20 extends into the tool head opening, its upper edge being disposed beneath the upper edge of the tool head 21.

In use, a piece of masking tape 23 is first positioned manually or otherwise in overlying relationship to the tool head opening 24 of the tool head 21. Downward movement of the control knob 13 operates the cylinder 12 to cause downward movement of the shaft 14, connector 15, applicator housing 16 and applicator 17.

Figure 2:
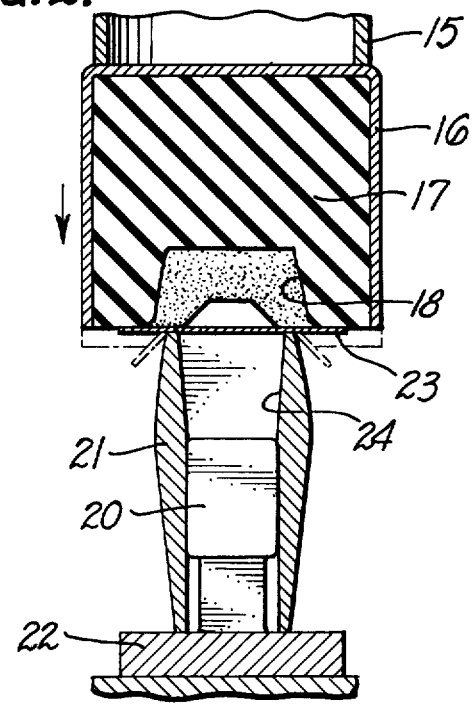
FIG. 2 is an enlarged partial sectional view of the same taken on line 2—2 of FIG. 1, showing the tape applicator in partly lowered position about to engage the tape, with a slightly lower position of the applicator and bending of the tape indicated in phantom lines.
Figure 3:
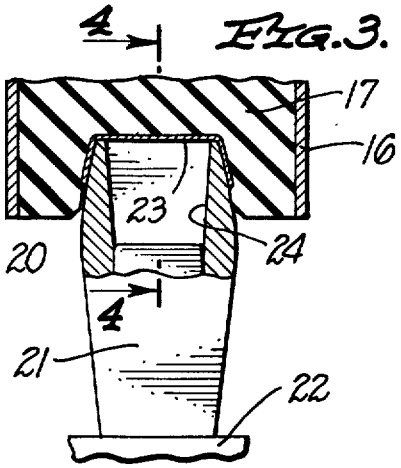
FIG. 3 is an enlarged partial sectional view similar to FIG. 2, showing the applicator in its lowest position, pressing the tape against the tool head.
Figure 4:
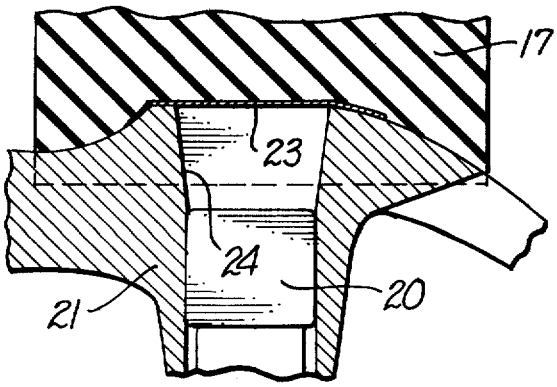
FIG. 4 is an enlarged partial sectional view taken on line 4—4 of FIG. 3.
Figure 5:
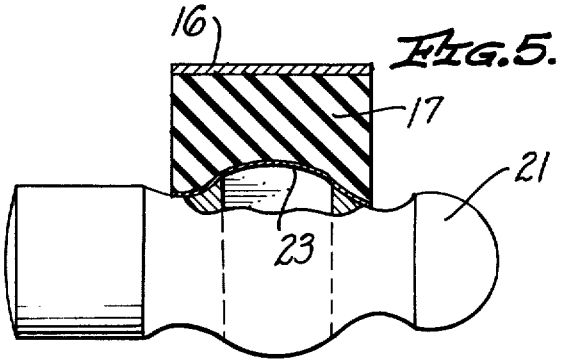
FIG. 5 is an enlarged partial sectional view similar to FIG. 4, showing use of the invention with a ball-peen hammer.

As best shown in FIG. 2 of the drawings, such downward movement causes the applicator 17 to first engage the tape 23 adjacent to, but preferably slightly outwardly from, the outer edge of the top of the tool head 21 surrounding the opening 24.

As the applicator 17 moves downwardly, it causes the portions of the tape 23 which protrude outwardly beyond the edges of the top of the tool head 21 to be bent downwardly. At this time, pressure is applied upon all of the peripheral edges of the tape 23 substantially simultaneously while no pressure is applied against the midportion of the tape 23 which extends across the top of the opening 24. This results in the tape 23 being pulled outwardly and stretched or drawn drumhead tight across the top of the opening 24.

After the tape 23 has been so tightened, further downward movement of the applicator 17 causes the peripheral edges of the tape 23 to be pressed inwardly into engagement with the sides of the tool head 21 beneath and surrounding the opening 24. The inward pressure of the applicator 17 against the tape 23 is at its maximum at the bottom of the downward movement of the shaft 14.

The applicator 17 is preferably held in its extreme downward position for a brief period of time, such as from several seconds to half a minute, in order for the pressure and time to cause a bond to be formed between the tool head 21 and the adhesive carried by the tape 23.

The applicator 17 is then released for upward movement, which release may be controlled manually by upward movement of the control knob 13 or which may be controlled automatically by timed operation of the cylinder 12.

The applicator 17 in its lowermost position applies simultaneous and continuous downward and inward pressure against the tape 23, holding the tape 23 tightly drawn over the opening 24 and simultaneously bonding it to the tool head 21 to fix it in such position. It can thus be seen that the assembly tool of the present invention will apply the masking tape 23 to the tool head 21 automatically in such a manner that it is uniformly and completely sealed with each application, thereby eliminating the uncertainties, expense and poor appearance of manual application.

I claim:

1. An assembly tool for use in connecting fiberglass handles to tool heads, said assembly tool comprising means for holding a tool head with a piece of masking tape extending across the top of said tool head in overlying relationship to the handle receiving opening of said tool head, a tape applicator movable with respect to said tool head, said applicator having a concave resilient pad formed complementarily to the convex portion of said tool head surrounding said opening, said pad being constructed and arranged so that said pad upon movement thereof toward said tool head engages all of the peripheral edges of said tape adjacent to and surrounding said opening and moves said edges downwardly simultaneously while applying no pressure against the portion of said tape which extends across the top of said opening, whereby said tape is drawn tightly across the top of said opening, said pad being adapted upon further movement toward said tool head to press the portions of said tape disposed outwardly from said opening inwardly simultaneously into sealing engagement with said tool head around the entire periphery of said opening while said tape is held tightly drawn across said opening to seal said opening against leakage of potting compound inserted into said opening to bond a handle to said tool head.

2. The structure described in claim 1, said pad being formed of cast silicon rubber.

3. The structure described in claim 2, said rubber having a Shore A hardness in the range between 20 and 60.

* * * * *